United States Patent [19]

Lowry et al.

[11] Patent Number: 4,709,749

[45] **Date of Patent: * Dec. 1, 1987**

[54] CONTINUOUS METAL CASTING APPARATUS

[75] Inventors: Hugh R. Lowry, Fairfield, Conn.; Robert T. Frost, Berwyn, Pa.

[73] Assignee: General Electric Company, Bridgeport, Conn.

[ * ] Notice: The portion of the term of this patent subsequent to Nov. 8, 2000 has been disclaimed.

[21] Appl. No.: 941,997

[22] Filed: Dec. 15, 1986

Related U.S. Application Data

[63] Continuation of Ser. No. 430,830, Sep. 30, 1982, which is a continuation of Ser. No. 165,421, Jul. 2, 1980, abandoned.

[51] Int. Cl.[4] ..... B22D 27/02

[52] U.S. Cl. ..... 164/503; 164/154

[58] Field of Search ..... 164/466–468, 164/498–500, 502–504, 148.1, 147.1, 452, 454, 154

[56] References Cited

U.S. PATENT DOCUMENTS 4,414,285 11/1983 Lowry et al. ..... 164/467 X

FOREIGN PATENT DOCUMENTS 48-5413 2/1973 Japan ..... 164/502

*Primary Examiner*—Kuang Y. Lin

*Attorney, Agent, or Firm*—Charles W. Helzer; Arthur E. Bahr

[57] ABSTRACT

The new apparatus of this invention comprises an elongated casting vessel disposed in upright position to receive liquid metal for solidification, means for delivering liquid metal into the lower portion of that vessel, heat exchange means associated with the vessel for cooling and solidifying the liquid metal therein, means for removing solidified metal from the upper portion of the vessel, and electromagnetic field generating means disposed around the vessel along a portion of its length. The field generating means includes a plurality of electromagnetic coils for connection to successive phases of a polyphase electric current source to produce a combined electromagnetic upward levitating field effect and a containment field effect on liquid and metal in the vessel. By "levitating effect" is meant that liquid metal is continuously suspended in space and urged upwardly into contact with the lower end of the solidifying product. In this way, voids and flaws are avoided. The containment field effect produces a slight gap between the walls of the casting vessel and the liquid metal so as to induce a pressureless contact condition in the solidification region. The casting apparatus includes a crucible to contain a bath of molten metal communicating with the lower end of the casting vessel and also includes means associated with the crucible to move liquid metal upwardly into the casting vessel to a level above the lower end of the electromagnetic field generating means. Such may take the form of a hydrostatic pressure source which operates to displace liquid metal upwardly into the casting vessel.

13 Claims, 8 Drawing Figures

CONTINUOUS METAL CASTING APPARATUS

This is a continuation of application Ser. No. 430,830, filed Sept. 30, 1982, which is a continuation of Ser. No. 165,421 filed July 2, 1980, now abandoned.

The present invention relates generally to the metal melting and solidification art and is more particularly concerned with a unique apparatus implementing a method of electromagnetic casting as disclosed in U.S. Application Ser. No. 430,830, filed Sept. 30, 1982, with respect to which this application is a divisional application, and with the resulting new products.

BACKGROUND OF THE INVENTION

Continuous casting has long been one of the more active areas of innovation in the metallurgical field and as a result a relatively large volume of patent and other technical literature has developed and continues to grow. For a variety of reasons, however, comparatively very few of the concepts set out in the voluminous prior art have materialized in commercial form. The continuous casting systems for metal that have reached commercial status have usually involved the use of some type of mechanical contacting mold to contact, contain and shape molten metal such as copper while it is solidifying. These molds take the form of casting wheels and casting belts and may in the case of the so called "dip-forming" process take the form of seed rod which is in effect an internal mold.

As will be developed in more detail below, the present invention involves as a central feature the use of an alternating electromagnetic field to create, support and contain out of continuous contact with any containing surface upwardly moving molten metal, and eliminates the necessity for the casting wheel, the casting belt, the seed rod or other contacting molds now used in the industry. In addition to simplifying the continuous casting of metals and other commercial production systems, the process of this invention opens the opportunity of making small to moderate quantities of brass, nickel and other metallic products by continuous casting instead of by the more expensive billet casting and hot rolling processes presently in general use.

With generally the same objectives in view, others have proposed the use of an electromagnetic mold to contain a metal melt pool on top of a downwardly moving ingot while the outer lateral portions of the pool are being solidified. This general departure is described in U.S. Pat. No. 3,467,166 (Getselev, et al) and is further developed in U.S. Pat. No. 3,605,865 (Getselev); U.S. Pat. No. 3,735,799 (Karlson); U.S. Pat. No. 4,014,379 (Getselev); and U.S. Pat. No. 4,126,175 (Getselev). In each instance, accretion is longitudinal, melt being delivered semi-continuously or continuously by gravity flow on the upper end of the descending ingot. One of the more serious drawbacks of this approach is the fact that the "fail safe" characteristic of casting upwardly is absent. Thus, in the event of an unexpected electric power failure, molten metal will spill out of the downward casting apparatus instead of merely running back, as in this invention, into the holding vessel. In addition, the possibility of melt overflow and breakout in downward casting require constant careful control of both the melt feed rate and the ingot removal rate. Moreover, these rates are drastically limited by a heat exchange problem which consequently diminishes the commercial potential of this special type of continuous casting.

According to another recent departure described in U.S. Pat. No. 3,746,077 (Lohikoski, et al) and 3,872,913 (Lohikoski) assigned to Outokumpo Oy, molten metal being either hydrostatically forced or pulled by vacuum upwardly into an open-ended, vertically-disposed mechanical mold as freshly-formed and cooled cast product is discontinuously and intermittently removed from physical contact with the upper end of the mechanical mold which contains the molten metal. In this way, the fail-safe feature is gained but only by accepting the major shortcomings of the external contact mold and the extraction mechanisms associated with its use.

SUMMARY OF THE INVENTION

By virtue of the inventions and discoveries set forth in general terms immediately below and later described in detail in reference to the accompanying drawings, the advantages stated above and others of importance to be described can be consistently obtained in continuous metal casting production operations. Further, these results are obtainable in the production of copper and other metal products such as rods which can be further processed in the usual manner to produce an end product such as wire. Still further, no economic penalty is imposed, but, on the contrary, these inventions and discoveries enable substantial production cost savings in certain product lines. By way of example, these inventions enable production of welding rods and other products in which grain size is not of primary importance by continuously casting directly to final desired size. As still another important advantage, this invention is generally not subject to compositional limitations, being applicable to the production of rods and other long length forms of other metals and alloys including, but not limited to, aluminum, aluminum-base alloys, copper, copper-base alloys, steel and the like.

This invention centers in the basic new concept of continuously casting upwardly by moving liquid metal into and through a forming zone in which it is progressively cooled and solidified while being subject to an electromagnetic field which reduces the force required to remove the resulting cast product from the forming zone. This important novel application of the electromagnetic field is accomplished in accordance with this invention by levitating and by containing the molten metal throughout the greater part of its travel in that portion of it in the region where solidification is occurring (solidification zone). Levitation is accomplished by means of electromagnetic upwardly traveling waves applied in the preferred practice of this invention so that a major portion of the length of the metal being cast is maintained essentially weightless throughout the casting operation. The electromagnetic field also includes a containment component which likewise is continuously applied, serving to maintain the liquid metal throughout most of its length in the solidification zone totally free from contact with physical mold structure. In the practice of this invention, the levitating and the containing effects are employed simultaneously so that molten metal is established and maintained essentially weightless and out of contact with physical mold structure throughout the major part of its length. Thus, the electromagnetic field performs both the lifting function and the containing or mold function.

It will be understood that there are important advantages associated with this basically new departure from prior practice and that electromagnetic levitation opens the opportunity for high production rates by virtue of the fact that inasmuch as the metal is essentially weightless, it is not necessary to drastically cool the freshly solidified portion of the metal product to any great extent in order to develop sufficient tensile strength in it to support the weight of the metal below and also to withstand the tensile forces involved in removing the product from the forming zone. In other words, the work necessary to withdraw the solidified metal product from the casting vessel is very considerably diminished because mold-casting friction is non-existent. In the practice of this invention the compressive force of the molten liquid is disappearingly small because of the weightless condition of the molten metal and the consequent pressureless contact of the molten metal with the casting vessel (i.e. reduced hydrostatic head to substantially zero value). A principal advantage of the combined electromagnetic levitation and containment fields is thereby obtained without impairment of the heat exchange effectiveness of the physical mold, there being in preferred practice no need for a significant space or gap between the physical casting vessel and the molten metal throughout the greater part of the length of the latter.

Opportunity for greater production rates therefore is afforded by the combination electromagnetic levitation and containment mode of this invention. Thus, the force required to remove the freshly solidified product and advance the molten metal through the solidification zone is diminished materially by elimination of frictional and adhesional forces. Further, in respect to heat exchange effectiveness, it is possible to achieve good heat transfer by minimizing the width of the gap between the molten metal and the surrounding physical casting vessel.

An additional advantage of the combination electromagnetic levitation and containment mode is the fact that the levitation and containment effects can be readily established and maintained under close control over a wide range of power input conditions. Thus, we have surprisingly discovered that this combination mode has a remarkable self-regulating characteristic, the containing and levitating forces being interrelated in their operating effects. In the case of casting rod, with the diameter of the molten metal column fixed at a desired value, an increase in upward travel rate of the molten metal column results in a reduction in its cross-sectional size and consequent decrease of the electromagnetic lifting force applied to the column. As the upward rate then slows and the cross-section of the column consequently increases, the lifting force increases so that while the system may exhibit a slight hunting tendency, it will never be far from equilibrium and the product will be substantially uniform in cross-sectional size and shape.

As generally indicated above, we have further found that this new continuous casting apparatus is broadly applicable to the casting of metals, metal mixtures, metal alloys and indeed to all electrically-conductive molten materials that can be solidified by the extraction of heat. Another closely related unexpected discovery is that under the condition of essentially zero hydrostatic head, there is enough induced eddy current flow in the liquid metal and consequent stirring of the molten liquid as solidification proceeds apace with travel through the levitation zone that a high degree of homogeneity in cast product apparently results even in those metal mixtures exhibiting marked selective segregation and solidification tendencies.

Broadly and generally described, the method carried out by the apparatus of this invention embodying foregoing inventions and discoveries comprises the steps of forming an elongated, upwardly extending, alternating electromagnetic field, introducing liquid metal into the lower part of the field, solidifying the metal while moving upwardly through the field, and removing solidified metal product from the upper part of the field.

As previously indicated, in preferred form, the method carried out by the apparatus of this invention, briefly described, comprises continuously casting in accordance with the steps described immediately above and particularly the step of electromagnetically levitating the liquid metal in the field to the extent that a major part of that metal is essentially weightless and in pressureless contact with the surrounding physical casting vessel structure.

The invention in its preferred form comprises apparatus for carrying out the steps of the method described broadly and generally above, and particularly the step of electromagnetically levitating a major part of the liquid metal to essentially weightless condition and at the same time electromagnetically maintaining the weightless liquid metal out of contact with lateral support structure.

As another feature of this invention, the electromagnetic field will be applied in a manner such that the surface of the major part of the liquid metal in the field will be maintained out of contact with support mold structure particularly in that critical part of the liquid metal where solidification of the metal is taking place.

Again in preferred practice of the process carried out by the apparatus of this invention, the levitation effect is such that at least part of the liquid metal is substantially without hydrostatic head, i.e., it is essentially weightless. The lifting force that is applied to move the metal being cast upwardly out of the forming zone, in the case of the casting of rod is provided by means of a starting rod joined in the initial stage of the process to the liquid metal which freezes in contact with the lower end of the starting rod. Withdrawal upwardly of the starting rod and of subsequent progressively solidified portions of the cast body is accomplished by suitable withdrawal means as the lower end of the solidifying liquid metal is continuously formed in stable maintenance of the continuous casting process.

In the practice of this invention the length of the electromagnetic field is suitably greater, and preferably considerably greater, than the diameter of the electromagnetic levitation field and the length of the levitated metal is greater than its diameter or other transverse dimension.

The new apparatus of this invention, likewise described in brief, comprises an elongated casting vessel disposed in upright position to receive liquid metal for solidification, means for delivering liquid metal into the lower portion of that vessel, heat exchange means associated with the vessel for cooling and solidifying the liquid metal therein, means for removing solidified metal from the upper portion of the vessel, and electromagnetic field generating means disposed around the vessel along a portion of its length. The field generating means may include a plurality of electromagnetic coils for connection to successive phases of a polyphase electric current source to produce an upward lifting effect on liquid and solidified metal in the vessel. By "lifting effect," we mean that liquid metal is continuously urged upwardly into contact with the lower end of the solidifying forming product. In this way, voids and flaws are avoided. More in detail, the apparatus includes a crucible to contain a bath of molten metal communicating with the lower end of the casting vessel and also includes means associated with the crucible to move liquid metal upwardly into the casting vessel to a level above the lower end of the electromagnetic field generating means. Such may take the form of a hydrostatic pressure source which operates to displace liquid metal upwardly into the casting vessel.

The novel products of this invention, likewise generally described, are long metal bodies which are fully dense and of substantially uniform cross section and constant composition throughout in each instance. In their as-cast condition, these bars, rods and other like products have smooth, slightly wavy surfaces attributable to the fact that before, during and just after solidification the metal of which they are formed is electromagnetically maintained out of contact with lateral support structure (such as a mold), and also due to the fact that the liquid metal at the solidification front is constantly stirred by induced eddy currents. The product may suitably be a rod of a composition which tends strongly to phase separation, however, because of continuous stirring by induced eddy currents the resulting product has a high degree of homogeneity.

In carrying out this invention in its preferred embodiment for producing rod,it is found that an average difference in diameter between the product held in levitation and the inside diameter of the casting vessel in which the product is being cast is about one to two thousandths of an inch. This together with the unique surface configuration verifies that the solidification of the rod product occurred out of continuous pressure contact with the casting vessel surface.

DESCRIPTION OF THE DRAWINGS

Those skilled in the art will gain a further and better understanding of this invention from the following detailed description taken in conjunction with the drawings forming a part of this specification, in which.

DETAILED DESCRIPTION OF THE PREFERRED EMBODIMENT OF THE INVENTION

Figure 1:
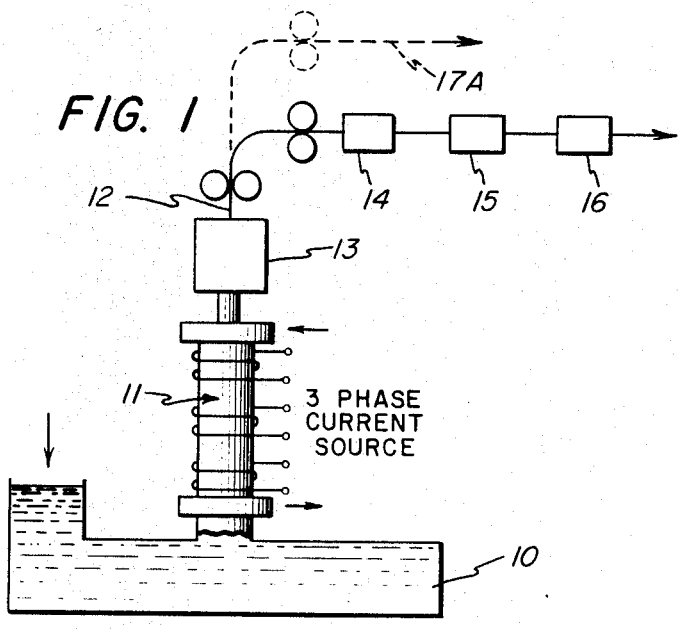
FIG. 1 is a diagrammatic view in elevation of apparatus embodying this invention in preferred form in combination with hot rolling apparatus.

As shown in FIG. 1, molten metal to be cast is contained in tiltable holding furnace (not shown) from which it is delivered into casting crucible 10 as required to maintain the desired level of liquid metal within casting assembly 11. The casting assembly is mounted on and extends vertically upwardly from crucible 10 to an open upper end through which freshly cast metal product such as rod 12 is discharged into cooling chamber 13 from which it is transferred to tandem hot-rolling stations 14 and 15 and then finally cooled and coiled at coiling station 16. Alternatively, rod 17A can be cast directly to any final desired size, cross sectional configuration or shape to produce rods, bars and the like for use. During operation, molten metal is displaced from crucible 10 as a liquid metal column into casting assembly 11 by gravity flow from the holding furnace which is tilted into charging position to deliver molten metal into crucible 10 at intervals or continuously as necessary during the continuous casting process. In preferred practice of this invention, column 20 (FIG. 2) of liquid metal is thus initially established and thereafter maintained at a level above that at which electromagnetic traveling wave levitation becomes effective to reduce and even eliminate the column hydrostatic head. In other words, the upper end of column 20 at the outset is brought within the lower portion of assembly 11 where at least the upper part of column 20 will become essentially weightless when the levitating apparatus of the casting assembly is connected to 2nd supplied from its electric power source.

Casting assembly 11 includes an open-ended casting vessel 25 which may be of refractory material secured to crucible 10 to receive liquid metal therefrom for solidification and eventual discharge as cast product from its open upper end into cooling chamber 13.

Figure 3:
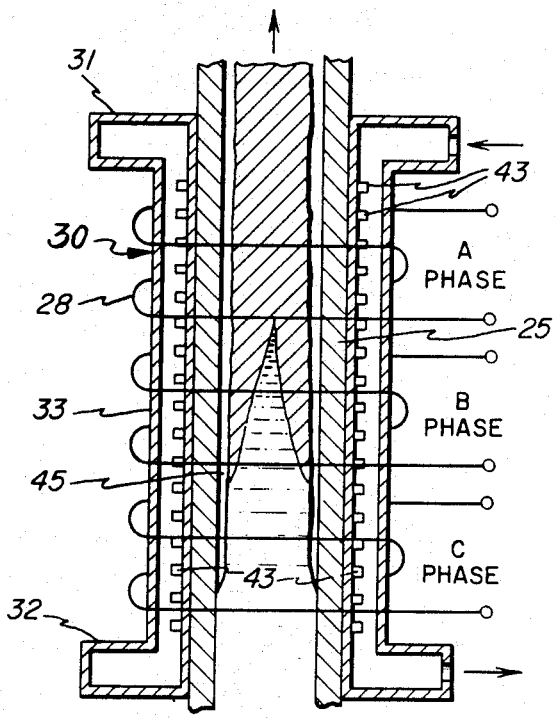
FIG. 3 is an enlarged, cross-sectional, semi-schematic view of the casting vessel of FIG. 2 illustrating a preferred apparatus for providing a combined levitation and containment electromagnetic field within the casting vessel for the practice of our invention.
Figure 5:
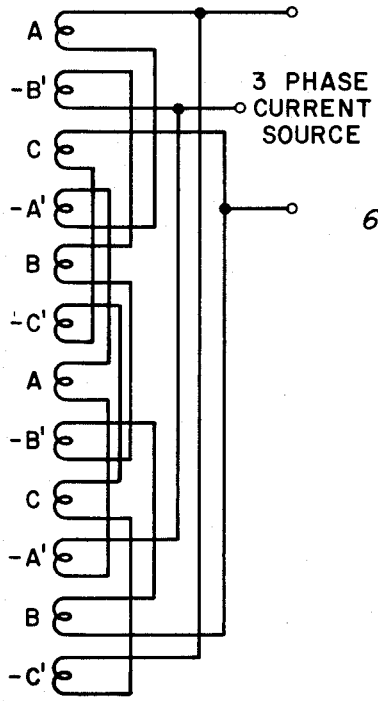
FIG. 5 is a wiring diagram of a levitation coil such as may be employed in the assembly of the apparatus of FIGS. 1–4.
Figure 6:
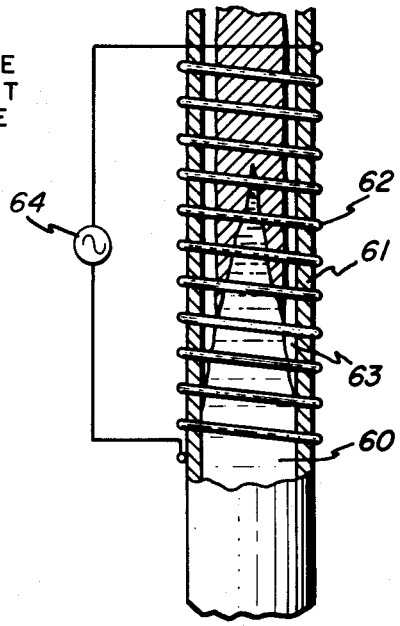
FIG. 6 is a schematic diagram of a single phase coil surrounding a casting vessel and illustrates the effect on the liquid metal column of the containment field produced by the coil.

In one example, twelve coils diagrammatically indicated at 28 in FIG. 3, are disposed in vertical spaced relation around casting vessel 25 as windings arranged substantially normal to the casting vessel axis and are connected in groups of three to successive phases of a polyphase electric current source as shown in FIG. 5. This arrangement creates an upwardly travelling magnetic field which will induce Foucault currents in the liquid metal in casting vessel 25 resulting in an upward lifting effect upon the liquid metal being cast in the solidification region. This six-phase levitator assembly thus is operable to produce a progressive upwardly traveling wave which will move at a speed proportional to the distance between successive closed flux loops and the frequency of excitation. Coils 28 constituting the heart of the levitator means are arrayed vertically along the length of the casting vessel 25 so that liquid metal and solidified metal product in all but the lowermost section of casting vessel 25 can be levitated throughout the casting operation to the desired extent, substantially to weighlessness during solidification. The portion of casting vessel 25 surrounded by coils 28 thus defines the solidification zone of the apparatus.

An experimental model of this invention apparatus used to produce continuously cast copper, aluminum and bronze rods in demonstration of operability of the present apparatus had a levitation section of 36 turns of copper tubing wound at a pitch of six turns per inch giving an overall levitation section of six inches. The 12 phases were each removed 60° in phase from its immediate neighbors and the section was effectively two wave lengths long. The diameter of the levitated metal columns was 22 mm and the column was maintained without acceleration (i.e., the levitation ratio was essentially 1.0) at a frequency near 1200 Hertz as the total DC power supplied to the motor-alternator AC levitator power source ranged from approximately seven to ten kilowatts. The heat exchanger illustrated in FIG. 4 was employed.

While heat exchangers of a variety of designs and constructions can be used with apparatus of this invention, the one best suited for this purpose and consequently our preference in this combination is shown at 30 in the drawings. Heat exchanger 30 is of fabricated sheet metal construction comprising upper and lower annular plenums 31 and 32 and a cylindrical section 33 fitted around casting vessel 25 in contact with the annular outer surface thereof. Liquid coolant, suitably tap water, is continuously delivered from a source (not shown) into upper plenum 31 and flowed through section 33 throughout the metal casting operation and is withdrawn through lower plenum 32 to a drain carrying with it the heat absorbed through casting vessel 25 from the liquid metal therein and the freshly solidified metal product therein. Coils 28, as illustrated in FIG. 3, are disposed outside the central section of the heat exchanger 30, extending substantially from one plenum to the other in uniform spaced relation and closely spaced radially around the heat exchanger. A suitable material of construction of heat exchanger 30 is stainless steel because of the corrosion resistance and heat exchange effectiveness of such alloys.

In carrying out this invention as we presently prefer, crucible 10 is charged with molten metal such as copper to be continuously cast in the production of articles of long length such as rod. Thus, as a preliminary step, the metal is melted and delivered into crucible 10 from a holding furnace (not shown) to move liquid metal column 20 upwardly in casting vessel 25 with its upper end within the levitation portion of casting assembly 11. As starter rod 40 is introduced through the upper end of casting vessel 25 to bring the lower end of the rod into contact with the top of the liquid metal column. With cooling water running at full velocity through the heat exchanger, an upper portion of the liquid metal column is solidified in contact with the rod. Rod 40 and accreted metal to the rod end is then withdrawn upwardly from casting vessel 25 at approximately the rate of formation of solid rod. The liquid metal column is maintained essentially weightless at least over most of its length in the solidification region and thus in essentially pressureless contact with casting vessel 25 in this situation by operation of the levitator means and the operation is maintained on a continuous basis, producing a continuous length of metal rod of smooth, shiny, slightly wavy surface and fully dense character throughout. This rod is carried through chamber 13 where water sprays reduce its temperature to the point at which it is in condition for final cooling and coiling with or without intermediate hot rolling.

As the level of liquid metal column 20 falls while the process continues, additional molten metal is delivered by gravity flow into casting crucible 10 so that the casting operation is continued without interruption.

The new process carried out by the apparatus of this invention has been successfully demonstrated through use of the apparatus in a number of experiments involving a variety of metallic materials. In particular, aluminum, copper and a bronze alloy have been cast in rod form in operations carried out essentially as described in detail immediately above. In each instance, the rod product was uniformly about 22 mm in diameter and was fully dense and of uniform composition throughout and had a smooth, shiny and slightly wavy surface. Electric power input to the levitator, however, was varied in accordance with the differences between the casting materials so as to match approximately the force of levitation to the weight of the levitated material, that is, to establish and maintain substantially zero acceleration levitation condition. Contrary to expectations, as indicated above, precise control of electromagnetic field strength is not necessary to maintenance of this levitation force-weight force balance due to its self-regulating characteristic.

During levitation, the liquid metal column 20 is accelerated upwards if the levitation force is greater than the weight force and this results in a reduction in the lifting force as a consequence of the reduction of the cross-section of the column caused by the greater levitation force, while the opposite is the case when the lifting force is less than the weight force. This gives rise to the above referred to self-regulating characteristic. While the full effect of the levitator means applies to a large part of the length of the liquid metal column 20 and the solidified rod product within the casting vessel 25, the parts of the column in the lower and upper extremities of the casting vessel 25, where levitation forces average only about one half of those described above, are supported, respectively, by the pressure head provided to raise the liquid column to initial height and by the lifting force applied through starter rod 40. Thus, as the liquid column is being established, a small upward acceleration is provided by those lower end region levitation forces and as the liquid metal column moves slowly upwardly an axial distance to a point about equal to the radius of the levitation coils, it enters fields strong enough to establish and maintain the column in an essentially weightless condition so that its contact with the casting vessel 25 is substantially pressureless. By pressureless, it is meant that there is no substantial continuous pressure contact between the outer surface of the liquid metal column and the interior surrounding surfaces of the casting vessel and the liquid metal is without substantial hydrostatic head in the critical solidification zone so that frictional and adhesive forces as well as the force of gravity acting on the solidifying metal column are reduced to a minimum in this critical zone. By increasing the pressure head, therefore, it is possible to increase upward flow velocities and more generally the initial pressure head can be used to regulate the velocity of such flow, the levitator means in conjunction with the withdrawal rolls then serving to maintain such initial flow at relatively constant value throughout the length of the levitator assembly.

In the interest of limiting the size of the casting equipment and particularly the levitator assembly and also minimizing the power input requirements to maintain the liquid column through the solidification stage, maximum heat exchange effectiveness is desirable and to this end the heat exchanger described above provides in effect a condition approaching a water quench by effectively enveloping the rising liquid metal column in a rapidly-flowing, turbulent, but fairly small cross-sectional annular stream of liquid coolant. The heat exchange between liquid metal column 20 and surrounding graphite casting vessel 25 bearing against the cylindrical surface of the stainless steel inner wall of the heat exchanger assembly 30 provides a highly efficient heat transfer capability. In the illustrated version of this heat exchanger that capability is further enhanced by short internal annular ribs 43 which serve as barriers to laminar flow, causing turbulence in the coolant liquid traveling downwardly through the heat exchanger from upper plenum 31 to lower plenum 32.

Figure 2:
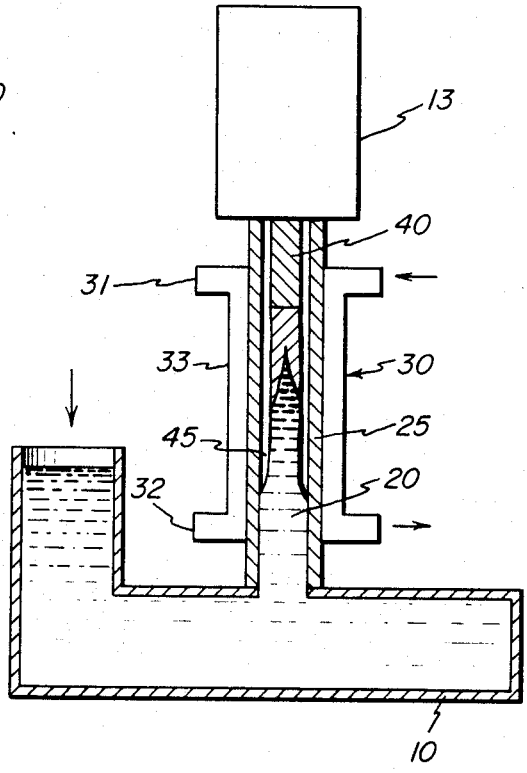
FIG. 2 is a schematic diagram in elevation of the casting assembly of the apparatus illustrated in FIG. 1.

While theory imposes virtually no limit upon cross-sectional size or shape of the products cast by the method of this invention, prevailing practical considerations fix the as-cast rod diameter range between about 5 mm and 50 mm, our own preference in the case of copper rod being 8 to 30 mm. Hot rolling will then result in the desired rod diameter and fine grain structure required for wire drawing. In any event, however, the inside diameter of casting vessel 25 and the operating parameters are selected so that in accordance with our preferred practice, there is a minimum annular gap between the liquid metal of column 20 and casting vessel 25. This is true below the point where solidification of the liquid metal 20 results in shrinkage of the column cross-sectional area although such shrinkage is quite small. The gap indicated at 45 in FIGS. 2 and 3 is schematic and not intended as an accurate representation of the location or of the dimensions of the annular gap.

Figure 4:
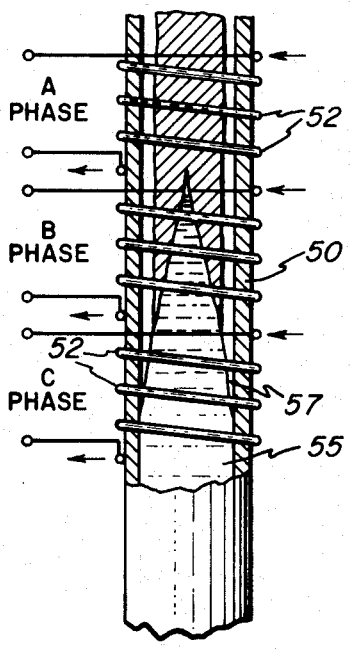
FIG. 4 is a view like that of FIG. 3 of alternative apparatus of this invention illustrating a different form of casting vessel and electromagnetic field producing coil assembly for providing the combined effects of liquid metal column containment and levitation.

In an experiment for the purpose of testing the capability of this new apparatus to produce essentially homogeneous castings of an alloy having a tendency toward selective segregation and solidification of different components, an aluminum-bronze alloy was melted and at three different times cast in accordance with this invention using apparatus essentially as described above with the exceptions that (1) the heat exchanger was a simple copper tube coiled around and in heat exchange contact with casting vessel 25 (as illustrated in FIG. 4) and (2) that liquid metal column 20 was established and maintained by displacement of melt from crucible 10 by piston action instead of by gravity flow from a holding furnace. Results of analyses of the alloy used to form the molten metal and of the three rod products are set forth in Table I from which it is apparent that within the accuracy of the sampling and analytical techniques used, the integrity of the alloy composition was fully maintained.

TABLE I

| Element | Starting Material | Run 1 | Run 2 | Run 3 |
|---|---|---|---|---|
| Fe | 2.64% | 2.69% | 2.65% | 2.71% |
| Sn | .01% | .03% | .01% | .02% |
| Zn | .01% | .03% | .02% | .02% |
| Al | 10.35% | 10.12% | 10.02% | 10.05% |
| Mn | .49% | .76% | .68% | .72% |
| Si | .028% | .049% | .039% | .046% |
| Ni | 5.00% | 4.99% | 4.90% | 4.99% |
| Others | .03% | .03% | .03% | .03% |
| Cu | Rem | Rem | Rem | Rem |

The apparatus of FIG. 4 is a subassembly comprising a casting vessel 50 and a series of 12 separate copper coiling tubes indicated at 52 coiled on casting vessel 50 and spaced along the length thereof and connected separately to a source of coolant liquid such as tap water (not shown). Cooling tubes 52 are also operatively connected in groups of three to successive phases of the polyphase electric current source shown in FIG. 5 for producing the upward lifting effect described above and so serve two essential purposes. Also as in FIG. 3, the individual coil groups are represented by the letters A, B, C referring to the three phases of the FIG. 5 diagram illustrating the circuitry of the apparatus and its power source. Thus, this subassembly takes the place of casting vessel 25, heat exchanger 30 and twelve coils 28 in the FIG. 3 apparatus but in use as shown operates to provide both levitation and containment functions. In other words, this apparatus is used in such a way that liquid metal column 55 like column 20 is weightless throughout most of its length but unlike column 20 is over that same length maintained out of contact with casting vessel 50, being separated therefrom by an annular gap 57 preferably of small radial dimension.

Cover gas not detrimentally reactive with the metal being cast is employed and may be delivered into space 57 in any desired manner. Our preference for this purpose in copper casting is nitrogen or a mixture of nitrogen, hydrogen and carbon monoxide produced by burning natural gas and then separating and removing the $H_2O$ and $CO_2$ from the resulting gases.

Figure 7:
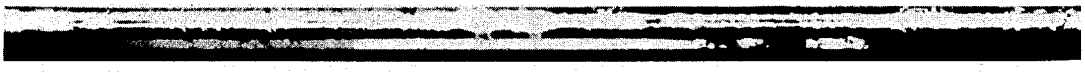
FIG. 7 is a photograph of a copper rod produced in accordance with the preferred practice of this invention.
Figure 8:
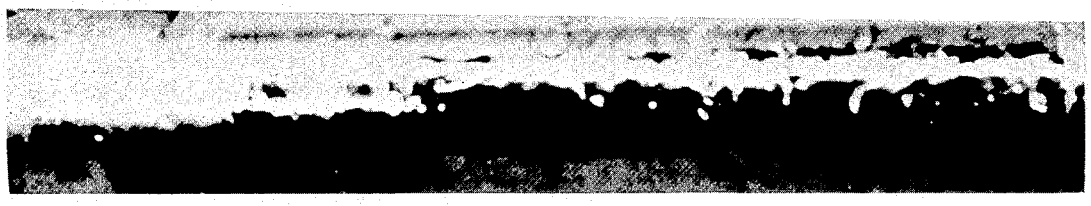
FIG. 8 is a close-up photograph of the bottom end of the copper rod of FIG. 7 showing the different surface characteristics discussed below.

The continuously cast copper rod product of this invention shown in FIGS. 7 and 8 was produced in accordance with the preferred practice of the invention method through the use of the FIG. 3 apparatus. In particular, the upward casting operation was carried out as described in reference to FIGS. 1–3, the electromagnetic levitation mode being used to maintain the liquid copper column weightless but in pressureless contact with the casting vessel throughout the upper portion of the column. The slightly wavy, smooth, shiny surface of the rod product is the result of keeping the liquid copper column from exerting pressure on lateral support structure at the point where the surface of the column was solidifying. It is also the result of the eddy currents induced in the solidifying copper by the levitating field. This fully dense product (8.9 by actual measurement and computation) was of apparently uniform composition throughout. The rod diameter closely approximated 16 mm which was the inside diameter of casting vessel 25 in which the rod was produced. The smooth dull band at the lower or left end of the rod is about 2 mils larger in diameter than the shiny, ripply surface portions, which shiny portions solidified while not in pressure contact with the levitator tube. This short, smooth dull band at the lower end of the rod solidified in a region of the heat exchanger below the region of effective levitation and the molten copper was, therefore, in continuous pressure contact with the casting vessel. The difference in appearance of the portions in continuous pressure contact and in pressureless contact are apparent.

Having described several embodiments of a metal casting apparatus constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What we claim as new and desire to secure by Letters Patent of the United States is:

1. Continuous casting apparatus comprising an elongated casting vessel disposed in upright position to receive liquid metal for solidification, means for delivering liquid metal into a lower portion of the vessel, heat exchange means associated with the casting vessel for cooling and solidifying liquid metal therein, electromagnetic levitation and containment field producing means disposed around the casting vessel along a portion of its length for simultaneously reducing the hydrostatic head of the liquid metal to a minimum and maintaining a predetermined dimensional relationship between the outer surface of the liquid metal and the interior surrounding surfaces of the casting vessel, excitation current supply means coupled to said electromagnetic levitation and containment field producing means for establishing and maintaining the electromagnetic levitation and containment field, means for controlling excitation current supplied to said electromagnetic field producing means for maintaining the value of the containment electromagnetic field so that the cross section of the liquid metal is less than the cross sectional area of the interior surrounding surface of the casting vessel to establish a slight gap but is sufficiently large to preclude formation of a substantial gap between the outer surface of the liquid metal and the interior surrounding surfaces of the casting vessel to thereby effect heat transfer between the liquid metal and the casting vessel sufficient to solidify the liquid metal while simultaneously reducing gravitational, frictional and adhesive forces acting on the liquid metal to a minimum, means independent from said electromagnetic levitation field producing means for moving the liquid metal upwardly into the casting vessel and within the electromagnetic field, and means for removing solidified metal product from the upper portion of the vessel.

2. The apparatus of claim 1 in which the electromagnetic levitation and containment field producing means includes a plurality of electromagnetic coils for connection to successive phases of a polyphase electric current source for producing an upwardly travelling alternating electromagnetic field.

3. The apparatus of claim 1 in which the vessel is made of refractory material of substantially uniform inside cross section.

4. The apparatus of claim 2, including a crucible to contain a bath of liquid metal communicating with the lower end of the casting vessel, and means associated with the crucible to move the liquid metal upwardly into the casting vessel to a level above the lower end of the electromagnetic levitation and containment field producing means.

5. The apparatus of claim 4 in which the polyphase source is a three-phase generator whose output power can be set to produce a uniform and balanced upwardly travelling electromagnetic force in accordance with the type and size of metal being cast.

6. The apparatus according to claim 1 wherein the electromagnetic levitation and containment field producing means operates at a frequency of the order of one kilohertz.

7. The apparatus of claim 1 further including means for precooling the solidified metal product as it emerges from the upper portion of the casting vessel, means for rolling the product to a desired dimension and means for cooling the rolled product to an ambient temperature.

8. The apparatus of claim 1 further including means for precooling the solidified metal product, and means for cooling the product to an ambient temperature.

9. Continuous casting apparatus for producing solidified metal product from liquid metal, comprising a hollow, elongated casting vessel disposed in an upright position for receiving therewithin liquid metal to be solidified; heat exchange means associated with the casting vessel along at least a portion of the length thereof for cooling and solidifying liquid metal in the casting vessel; electromagnetic field producing means disposed around the casting vessel along at least a portion of the length thereof for simultaneously producing a levitation field for reducing the gravitational force acting upon the liquid metal to a minimum and a containment field for reducing frictional and adhesive forces between the liquid metal and the casting vessel by reducing the cross sectional area of the liquid metal thereby establishing a slight gap but precluding formation of a substantial gap so that there is no substantial reduction in the transfer of heat between the liquid metal and the heat exchange means and metal is solidified; means independent of the field producing means for moving liquid metal upwardly into the casting vessel and within the lower portion of the electromagnetic field; and means for taking away the solidified metal product from the upper portion of the casting vessel.

10. The apparatus of claim 9 in which the field producing means includes a plurality of electromagnetic coils for connection to successive phases of a polyphase electric current source for producing an upwardly travelling alternating electromagnetic field.

11. The apparatus of claim 10, including a crucible to contain a bath of liquid metal communicating with the lower end of the casting vessel, and means associated with the crucible to move the liquid metal upwardly into the casting vessel to a level above the lower end of the field producing means.

12. The apparatus of claim 10 further including means for precooling the solidified metal product as it emerges from the upper portion of the casting vessel, means for rolling the product to a desired dimension and means for cooling the rolled product to an ambient temperature.

13. The apparatus of claim 10 further including means for precooling the solidified metal product, and means for cooling the product to an ambient temperature.

* * * * *